US007150102B2

(12) United States Patent
Gringer et al.

(10) Patent No.: US 7,150,102 B2
(45) Date of Patent: Dec. 19, 2006

(54) PUSH-PULL STRIPPER-SCRAPER

(75) Inventors: Donald Gringer, New York, NY (US); Yuan Fang Cheng, Forrest Hills, NY (US)

(73) Assignee: Allway Tools, Inc, Bronx, NY (US)

( * ) Notice: Subject to any disclaimer, the term of this patent is extended or adjusted under 35 U.S.C. 154(b) by 71 days.

(21) Appl. No.: 10/970,222

(22) Filed: Oct. 20, 2004

(65) Prior Publication Data

US 2006/0080843 A1 Apr. 20, 2006

(51) Int. Cl.
*B26B 1/08* (2006.01)

(52) U.S. Cl. ..... 30/172; 30/171

(58) Field of Classification Search ..... 30/171, 30/172, 329, 334, 335, 337, 339; 15/236.05, 15/236.01, 236.06
See application file for complete search history.

(56) References Cited

U.S. PATENT DOCUMENTS

| | | | | | |
|---|---|---|---|---|---|
| 656,468 | A | * | 8/1900 | Mullin | 30/172 |
| 693,518 | A | * | 2/1902 | Hamilton | 30/172 |
| 736,741 | A | * | 8/1903 | Klemm | 30/143 |
| 952,746 | A | * | 3/1910 | Lane | 30/172 |
| 1,068,683 | A | * | 7/1913 | Malek | 30/172 |
| 1,463,745 | A | * | 7/1923 | Layne | 30/171 |
| 1,584,021 | A | * | 5/1926 | Melvin | 30/172 |
| 2,145,985 | A | * | 2/1939 | Krajicek | 30/294 |
| 2,286,190 | A | | 6/1942 | Abrahamsen | |
| 2,783,537 | A | | 3/1957 | Gringer | |
| 2,846,764 | A | * | 8/1958 | Hyneman | 30/172 |
| 3,162,947 | A | | 12/1964 | Gringer | |
| 3,250,000 | A | * | 5/1966 | Schumann | 30/171 |
| 3,688,401 | A | * | 9/1972 | Hartman | 30/171 |
| D240,699 | S | | 7/1976 | Gerson | |
| D267,826 | S | | 2/1983 | Gringer | |
| D274,952 | S | | 7/1984 | Gringer | |
| D274,953 | S | | 7/1984 | Gringer | |
| 4,558,517 | A | | 12/1985 | Gringer | |
| D282,881 | S | | 3/1986 | Gringer | |
| 5,001,796 | A | * | 3/1991 | Desjardins | 7/105 |
| 5,056,226 | A | | 10/1991 | Gringer | |
| D326,546 | S | | 5/1992 | Gringer | |
| D327,553 | S | | 6/1992 | Gringer | |
| D346,319 | S | | 4/1994 | Lavalle et al. | |
| RE34,979 | E | | 6/1995 | Gringer | |
| 5,433,004 | A | | 7/1995 | Thompson et al. | |
| D364,252 | S | | 11/1995 | Henke | |
| 5,528,832 | A | | 6/1996 | Schmidt | |
| D453,251 | S | | 1/2002 | Gringer et al. | |
| D463,639 | S | | 9/2002 | Panfili et al. | |
| D467,395 | S | | 12/2002 | McCool | |

(Continued)

*Primary Examiner*—Hwei-Siu Payer
(74) *Attorney, Agent, or Firm*—Gottlieb, Rackman & Reisman, P.C.

(57) ABSTRACT

In a preferred embodiment, the push-pull stripper-scraper comprises a single stripping blade and a quadruple-edged scraping blade. The stripping blade accommodates a sliding carrier plate which incorporates guide channels for sliding along the stripping blade. The carrier plate is adapted to retain the scraping blade, thus, the scraping blade moves in unison with the carrier plate as it shifts in position along the stripping blade. The carrier plate, stripping blade and scraping blade also include apertures through which a fastening means secures these respective components but which nevertheless selectively permits movement of the carrier plate along the stripping blade. Significantly, the device allows a user to switch between using the stripping blade and scraping blade, respectively, without changing tools. This is particularly advantageous when using the device in conjunction with an extension pole.

38 Claims, 8 Drawing Sheets

U.S. PATENT DOCUMENTS

| | | | | |
|---|---|---|---|---|
| D468,989 | S | 1/2003 | Gringer et al. | |
| 6,530,098 | B1 | 3/2003 | Gringer et al. | |
| 6,568,087 | B1 | 5/2003 | Gringer et al. | |
| D479,374 | S | 9/2003 | Gringer et al. | |
| D479,375 | S | 9/2003 | Gringer et al. | |
| 6,629,331 | B1 * | 10/2003 | Panfili et al. | 15/236.06 |
| D489,851 | S | 5/2004 | Jones et al. | |
| 6,732,395 | B1 | 5/2004 | Gringer | |

* cited by examiner

PUSH-PULL STRIPPER-SCRAPER

FIELD OF INVENTION

This invention relates generally to a multifunction instrument for mechanically removing the exterior coatings from a variety of surfaces. More specifically, this invention involves a combination stripping and scraping tool for removing paint, stain, varnish, glue, rust and other materials from walls, cabinets, siding and other surfaces.

BACKGROUND OF THE INVENTION

There are a number of ways to effectively remove old coatings of paint and varnish from walls, furniture or other surfaces where these materials are typically found. Some methods of removal include the use of power washers, heat guns or chemicals that soften and help eliminate the coatings. Despite these relatively recent innovations used by many handcraft design professionals and do-it-yourself craftsmen, many still prefer using traditional strippers and scrapers to perform these tasks.

Conventional pull-motion scrapers, which incorporate hardened steel and metallic edges, have been around for centuries, providing a traditional effective approach for removing paint and varnish from various flat surfaces, hardboard, wood and ferrous metal. Due to their sharpness, the blades of a scraper can efficiently remove many layers of paint or other materials, while leaving surfaces clean and ready for finishing. However, special care must usually be taken in order to avoid gouging or scoring of wood or other deformable surfaces. For heavier scraping on hard or metal surfaces, many use two-hand scrapers which provide additional leverage and stability.

A pull scraper incorporating a four-way blade, formed with two spoon shaped blades for fine scraping and two flat folded edges for rough scraping is disclosed in U.S. Pat. No. 6,568,087 to Gringer. Other forms of scrapers by Gringer are disclosed in U.S. Pat. Nos. 6,732,395, D 479,375, D 479,374 and 4,558,517.

On the other hand, push scrapers, commonly known as strippers, typically incorporate a single chisel-edged blade. The blade is not particularly sharp, which helps prevent users from gouging wood or other deformable surfaces. Generally, strippers are used to remove loose and peeling paint while continuing over layers that are still securely bonded to a surface.

Many scrapers and strippers sold on market are known to incorporate threaded cavities in the handle portion of the respective tools for purposes of receiving a correspondingly threaded extension pole or other extension means. A pole or similar extension device in combination with individual hollow-handled scrapers and strippers have allowed users to scrape and strip high walls without the use of a ladder or step stool and without having to constantly adjust their location along a wall. Similarly, with an extension pole, these devices can also be used to scrape and strip floors without users having to rest on their knees.

Despite the advancements with respect to manual scrapers and strippers, these tools suffer from at least one major drawback, namely that users must use separate scrapers and strippers to perform these related chores. In particular, after users scrape a given surface area, there is often loose paint or other coatings which must likewise be manually removed. Under such circumstances, users must then take the more delicately acting stripping device in hand in order to remove what remnants of paint or coating are left on the surface.

When using an extension device, this course of events is particularly frustrating since users must unscrew and transfer the extension device from the scraper to the stripper and then back again in the event that additional scraping needs to be done.

SUMMARY OF THE INVENTION

Accordingly, it is an object of the present invention to provide a combination stripping and scraping tool for removing paint, stain, varnish, glue, rust and other materials from walls and various other surfaces where these and other similar materials are located.

Another object of the present invention is to provide a stripping and scraping tool, which combines the efficiency of a conventional manual pull scraper with the more delicate and precise nature of a push stripper.

A further object of the present invention is to provide a combination stripping and scraping tool, which prevents users from having to switch between separate tools during a task which involves both stripping and scraping.

Another object of the present invention is to provide a combination stripping and scraping tool, which includes a threaded cavity for accepting an extension pole or other similar extension device for allowing users to use the device on high walls and floors alike.

Additional objectives will be apparent from the description of the invention that follows.

In its broadest aspects, the invention involves a multifunction tool that combines the advantages of a push stripper and pull scraper. The stripper-scraper comprises a single chisel-edged blade or stripping blade that is capable of stripping loose or peeling paint or other coatings from surfaces. The stripper-scraper also includes a second blade optionally incorporating four sharpened edges, capable of efficiently scraping one or more layers of paint and other coatings from surfaces.

The stripping blade accommodates a sliding carrier plate which incorporates guide channels. These channels are located at the sides of the carrier plate and guide the carrier plate along the stripping blade. Further, the carrier plate is adapted to retain the quadruple-edged blade. Accordingly, the quadruple-edged blade shifts in unison with the carrier plate as the carrier plate shifts in position along the stripping blade. The carrier plate, stripping blade and four-way scraping blade also include configured apertures through which a bolt and wingnut or other fastening means are snugly fastened, while still permitting movement of the carrier plate. During use, an elongated aperture in the stripping blade, in conjunction with the bolt and wingnut, permit sliding motion along the stripping blade while creating a stop that prevents the carrier plate, and hence the scraping blade, from completely sliding off of the stripping blade.

Further, the push-pull stripper-scraper preferably includes a soft elastomeric ergonomic handle with a threaded cavity disposed therein that is fitted for selectively attaching a corresponding end of a pole or other extension device. In this embodiment, the tool can be used to manually scrape and strip elevated surfaces and floors as desired without the use of a ladder or descending to the ground.

Significantly, the device allows a user to easily switch between the scraping blade and the stripping blade without having to employ separate tools for scraping and stripping. This is particularly advantageous when the device is used in conjunction with an extension pole. Since the device can be manipulated to allow a user to strip and scrape, it prevents a user from having to switch a scraping tool for a stripping tool at the end of a pole. Instead, while the device is located at the end of an extension pole, it can be manipulated by the user to strip or scrape as desired.

Moreover, when an extension pole is not being used in connection with the device, an insert is disposed in the cavity area at the proximal end of the handle. This insert may be optionally used as a hammer-head to drive loosened nails below the surface before painting or other coatings are applied.

BRIEF DESCRIPTIONS OF THE DRAWINGS

DETAILED DESCRIPTION OF THE INVENTION

Figure 1:
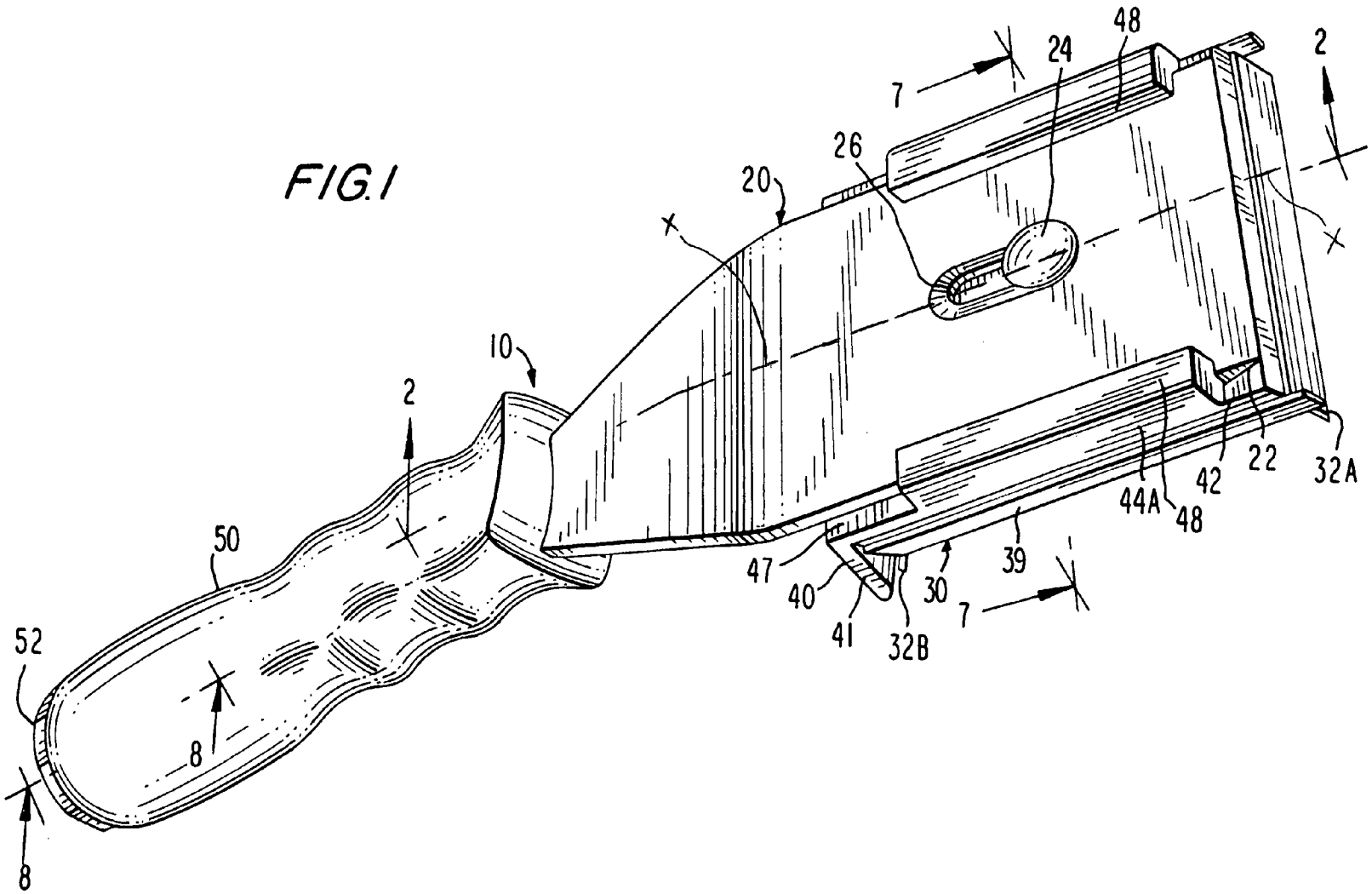
FIG. 1 is a top perspective view of the inventive push-pull stripper-scraper with the scraping blade in the extended or forward position.

Referring to the drawings, FIGS. 1 through 8 depict an embodiment of the inventive push-pull stripper-scraper 10 having a first blade, namely a stripper blade 20, a second blade, namely a quadruple-edged scraper blade 30, a carrier member or plate 40 and a handle 50. The stripper blade 20 preferably comprises a 2½ inch wide, single chisel edge 22 for stripping loose paint, varnish and various surfaces. Blades of varying widths which incorporate other types of edges that are well known in the art, including other angled or straight edged blades, may be used in place of the chisel edge 22 that is shown.

Figure 2:
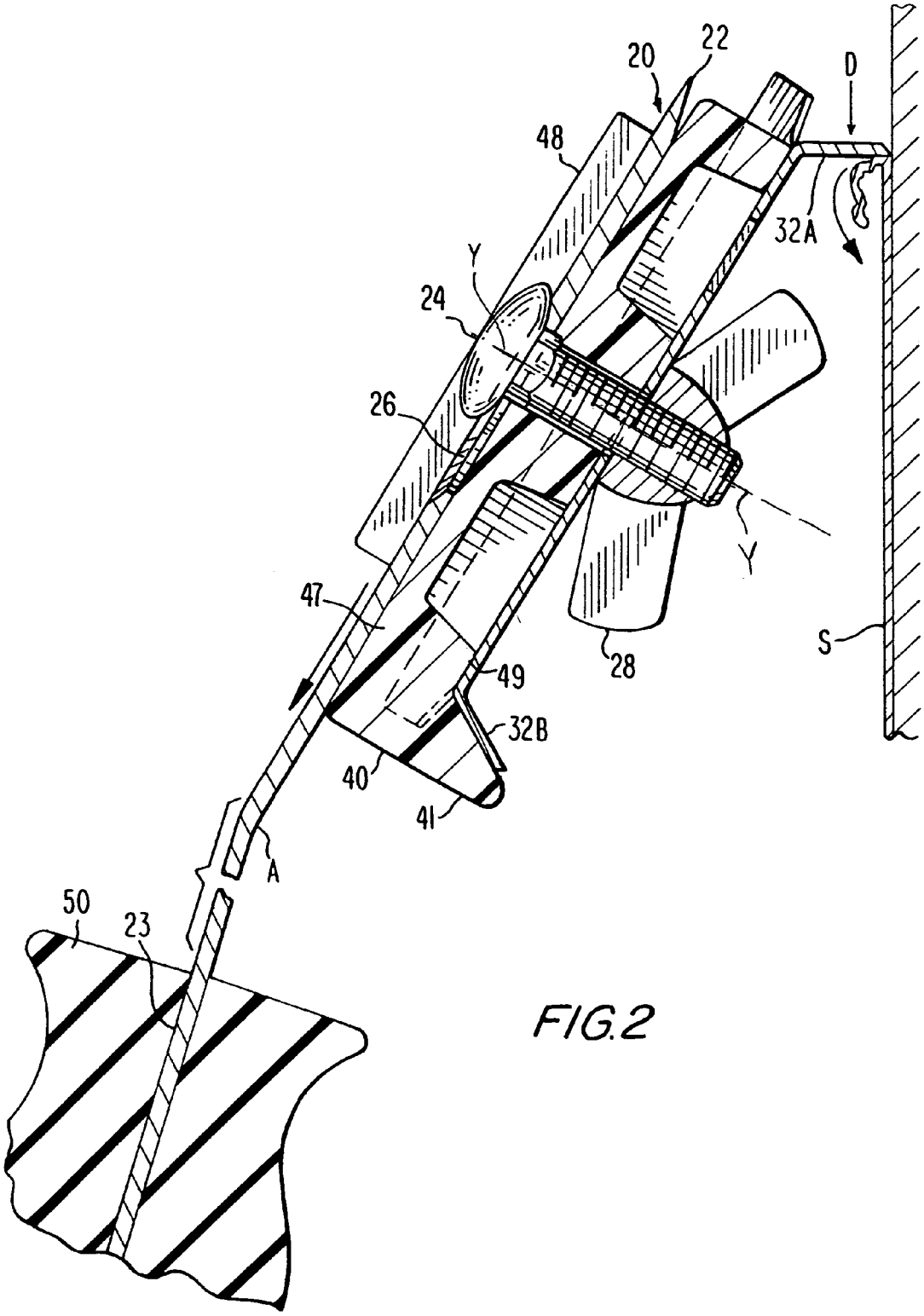
FIG. 2 is a partial cross sectional view of the push-pull stripper-scraper taken along line 2—2 of FIG. 1, with the quadruple-edged scraping blade scraping paint from a surface.

In the drawings, proceeding along longitudinal axis X in the direction from the chisel edge 22 to the rear or proximal end 23, the stripping blade 20 maintains a uniform width for the majority of the length of the blade 20, tapering as it approaches the handle 50 and forming a slight angle A. As shown in FIG. 2, the rear end 23 of the stripper blade 20 is internally joined to the upper portion of the handle 50. Numerous conventional means for attaching blades to handles may be used in practicing the invention.

Figure 5:
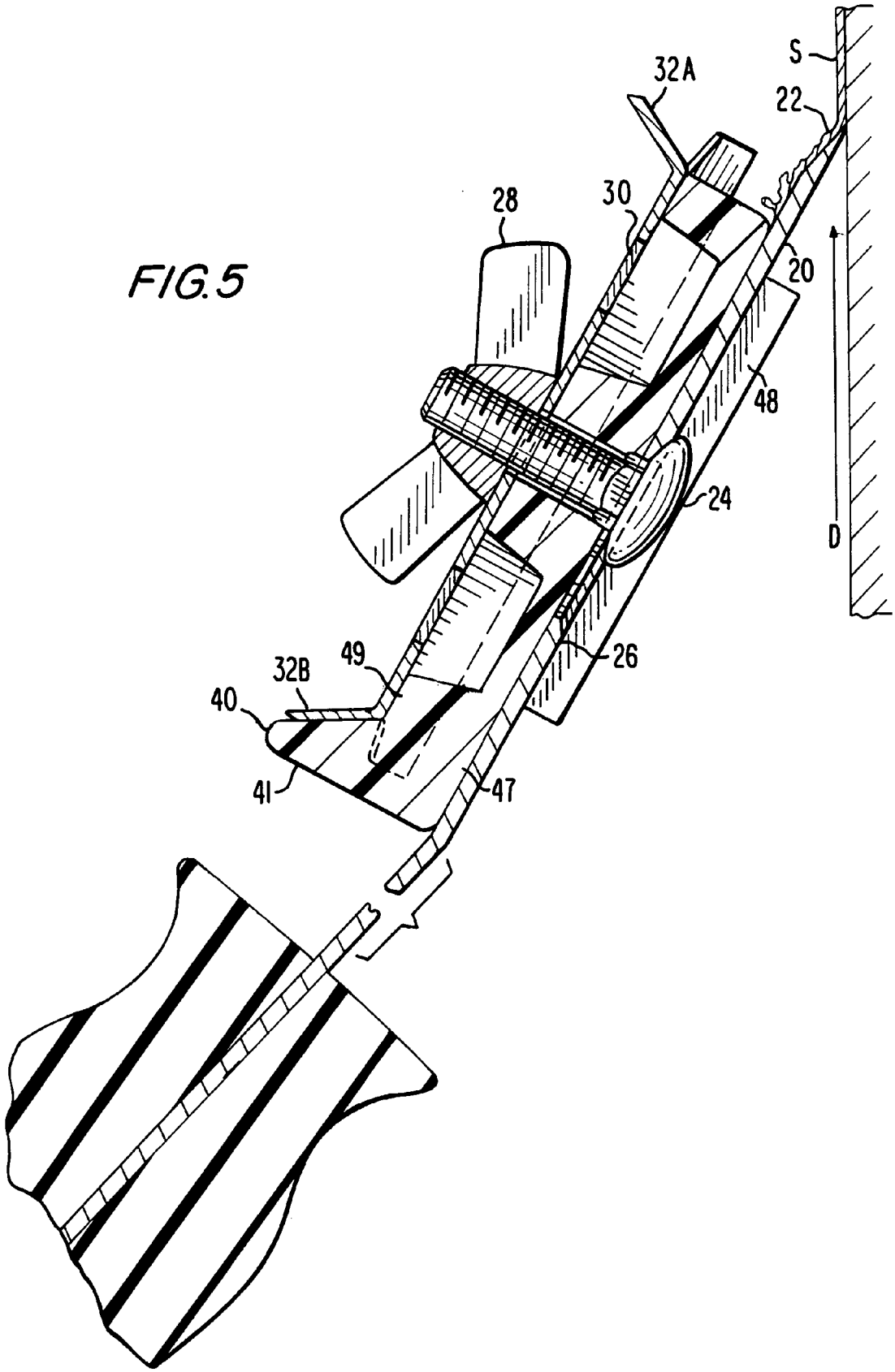
FIG. 5 is a cross sectional view of the push-pull stripper-scraper with the single-edged stripping blade stripping loose paint from a surface.
Figure 6:
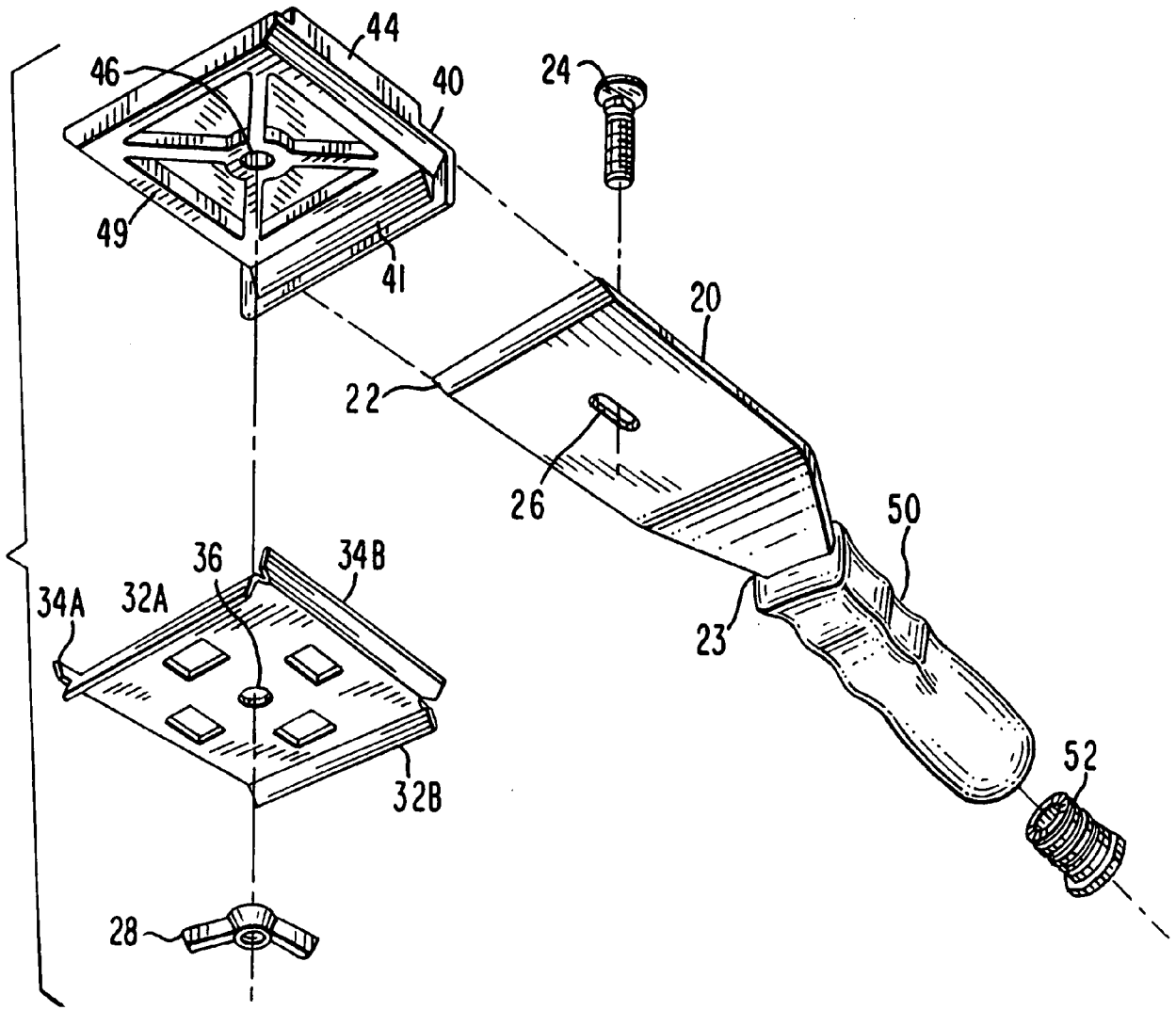
FIG. 6 is an inverted exploded view of the inventive push-pull stripper-scraper shown in FIG. 3.
Figure 7:
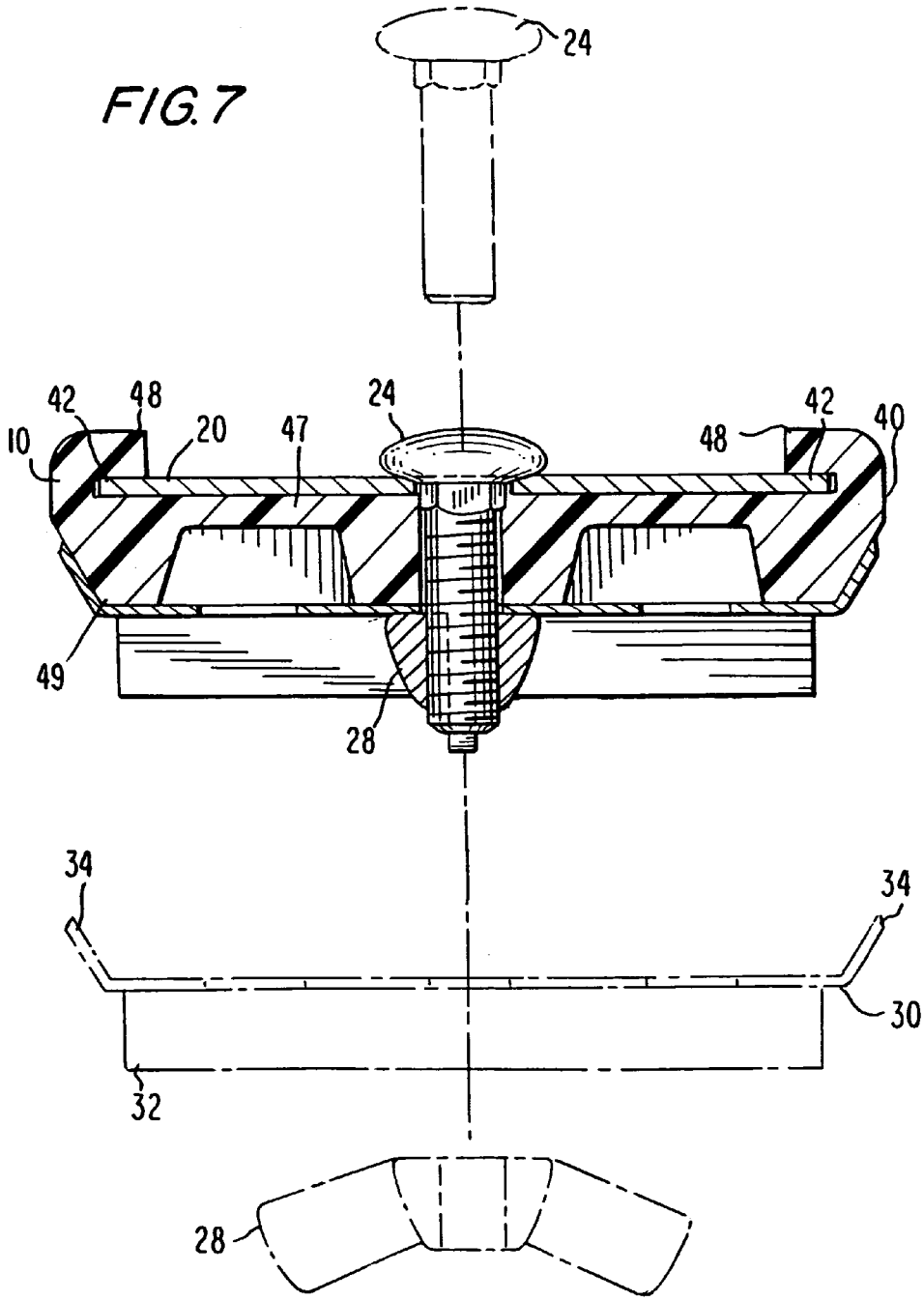
FIG. 7 is a cross sectional view of the push-pull stripper-scraper taken along line 7—7 of FIG. 1.

As shown in FIGS. 1 through 7, the stripper blade 20 accommodates and is in sliding connection with a carrier plate 40. The plate 40 includes a plurality of parallel guide channels 42 on the respective lateral edges 44 of the carrier plate 40. The channels 42 slidingly guide the carrier plate 40 along the stripper blade 20. The channels 42 are parallel and are formed by "U"-shaped facing projections 48 emanating from the lateral edges 44 of the plate 40 which extend over the upper surface 47 of the plate 40, as shown in FIG. 7. Accordingly, the upper and lower boundaries of the channels 42 comprise the projections 48 and the upper surface 47 of the plate 40, respectively. Of course, guide channels may be formed independently without utilizing the upper surface of the carrier plate as the lower boundary of the channels.

In order to accommodate a wider stripper blade 20 which may desirable for purposes of stripping a larger surface area with a single stroke, a correspondingly wider carrier plate 40 may be utilized. Likewise, if a relatively thicker stripper blade 20 is utilized to provide the blade with additional firmness and stability, the channels 42 may be expanded. Further, the carrier plate is preferably constructed from durable and resilient material, including hard plastics, but it may also be composed of metal or other materials.

The lower surface 49 of the carrier plate 40 accommodates the second blade, preferably a symmetrical quadruple-edged scraping blade 30. The dimensions of the plate permit only the forward-facing edge 32A of the scraper blade 30 to come into an operative scraping contact with a surface. The remaining three edges 32B, 34A, 34B, are configured to rest against the carrier plate 40. Thus, as shown in FIG. 7, the plate 40 comprises a slightly larger width dimension than that of the scraper blade 30, such that the lateral edges 34A, 34B of the blade 30 do not protrude, providing a degree of protection for users utilizing the device and preventing the edges 34A, 34B from inadvertently damaging a surface. Similarly, as shown in FIG. 2, the rear end 41 of the plate 40 also extends downwardly to act as a stop, sufficient to prevent the rearward facing edge 32B of the scraper blade 30 from coming into operative scraping contact with a surface.

The scraper blade 30 comprises a base and quadruple-edged blade 32A, 32B, 34A, 34B, desirably made of steel, sharpened and ground to form two types of edges, one pair for fine scraping 32A, 32B, and the other pair for rough scraping 34A, 34B. The edges 32A, 32B, 34A, 34B may also be curved or arcuate, allowing for more precision. Preferably, each of the fine scraping edges 32A, 32B and rough scraping edges 34A, 34B are located opposite one another respectively on the scraper blade 30. Furthermore, while the fine scraping edges 32A, 32B are angled downward, those of the rough scraping edges 34A, 34B angle upward, thereby permitting a user to use either one of the fine scraping edges 32A, 32B or rough scraping 34A, 34B without interfering with one another during the course of a scraping task. Conversely, when either of the rough scraping edges 34A, 34B is used for scraping, the fine scraping edges 32A, 32B angle in a generally upward direction and conform with the lateral edges 44 of the plate 40. In switching from a fine scraping edge 32A, 32B to a rough scraping edge 34A, 34B and vice versa, a user simply rotates the blade 90 degrees, generally parallel to the carrier plate 40, with respect to axis Y, which is generally perpendicular to axis X, and flips over the blade 30 so that the blades which are not in the operative scraping contact position rest against the plate 40. Further rotation of the blade 30 so that other edges may be utilized may be accomplished as well. Conventional edges and blades of various compositions and configurations may be incorporated in the scraper blade 30 instead of or in addition to those described herein.

As shown in FIGS. 2, 3, 5 and 6, the carrier plate 40 and scraper blade 30 incorporate apertures 46, 36, which are intended to be in alignment. Accordingly, when the blade 30 is properly positioned against the plate 40, a bolt or screw 24 is inserted through the apertures 46, 36. Preferably, the apertures 46, 36 are of generally equivalent dimensions, and are located at the center of the plate 40 and blade 30, respectively, permitting a user to utilize any one of the blades 32A, 32B, 34A, 34B at a given time without disturbing the basic configuration of the device 10.

Figure 3:
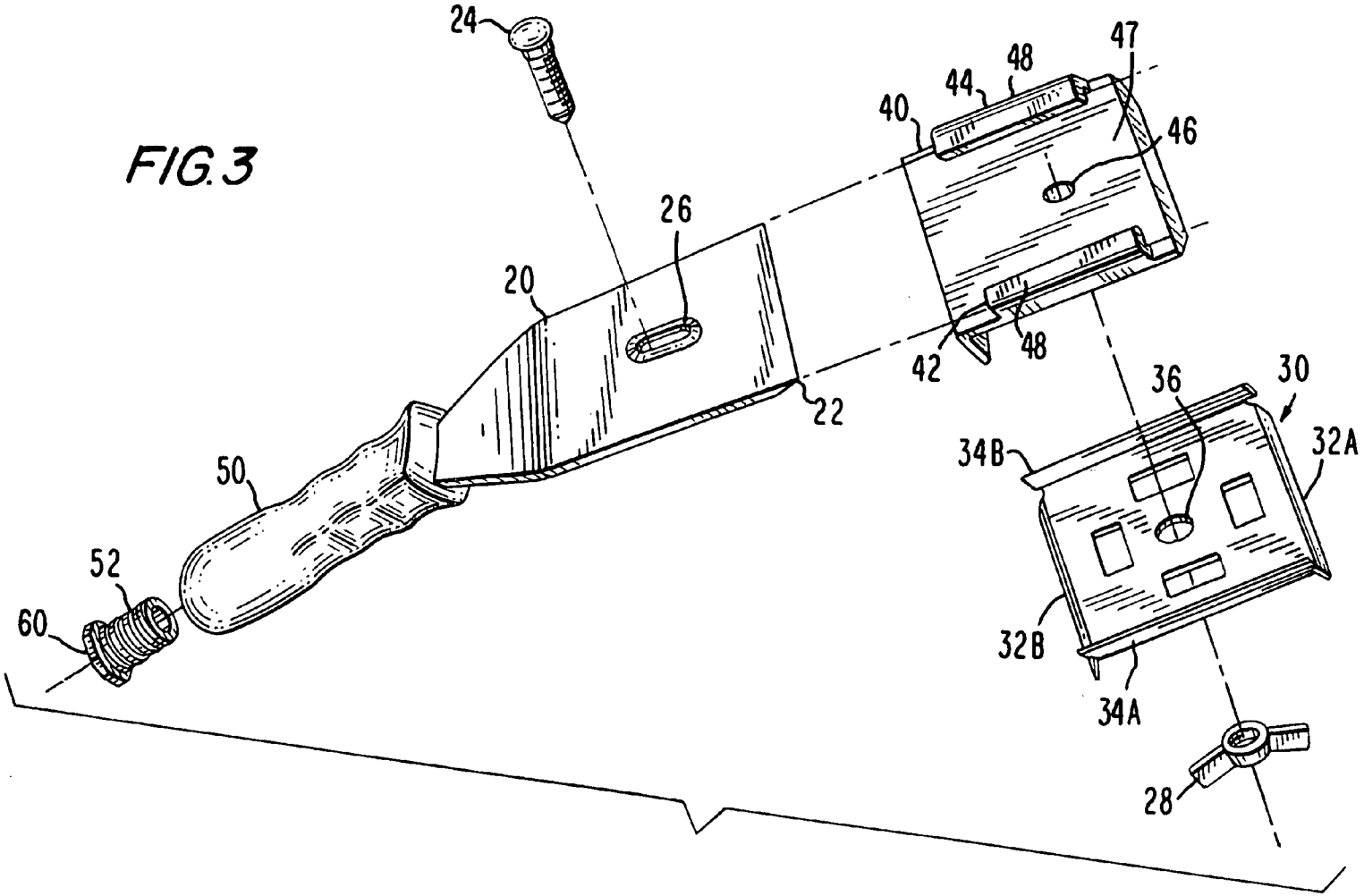
FIG. 3 is an exploded view of the push-pull stripper-scraper, showing the metallic hammer-head insert, hollow handle, stripping blade, carrier plate, quadruple-edged scraping blade and fastening means.

Stripper blade 20 incorporates an elongated aperture 26 located at the midpoint between the lateral edges of the stripper blade 20. Significantly, the aperture 26 is correspondingly positioned to be aligned in part with the apertures 36, 46 of the scraper blade 30 and carrier plate 40. Accordingly, as depicted in FIGS. 3 and 6, when the carrier plate 40 slidingly engages the stripper blade 20, the threaded bolt 24 passes through the apertures 26, 46 of the stripper blade 20 and carrier plate 40, as well as through the aperture 36 of the scraper blade 30. The bolt 24 is then securely fastened with a wingnut 28 or other tightening member at the opposite end, thus maintaining the scraper blade 30 against the lower surface 49 of the carrier plate 40, and the stripper blade 20 in sliding engagement with the carrier plate 40 adjacent to the upper surface 47. Accordingly, when fastened, the quadruple-edged blade (30) shifts in unison with the carrier plate (40) as it shifts in position along the stripping blade (20). While a number of conventional fastening configurations may be utilized in practicing the invention, it is preferable to use bolts and tightening members which are capable of being tightened and released with the fingertips of a user and without the use of mechanical instruments.

When fastened, the bolt 24 and wingnut 28 effectively prevent the carrier plate from sliding off of and disengaging the stripper blade 20. However, since the aperture 26 of the stripper blade 20 is elongated, sliding or axial motion of the carrier plate 40 and hence the scraper blade 30, at a predetermined distance equivalent to the length of the elongated aperture 26, is permitted along the longitudinal axis X of the stripper blade 20.

Importantly, if the bolt 24 and wingnut 28 are fastened too tightly, movement of the carrier plate 40 and scraper blade 30 along the stripper blade 20 is prevented, whereas if they are fastened too loosely, the carrier plate shifts too liberally along the length of the aperture 26, and may excessively slide depending on the orientation of the device 10 relative to the ground. Accordingly, it is desirable to snugly fasten the bolt 24 and wingnut 28 sufficient enough to permit movement of the plate 40 with the application of some force by the user but without fastening the bolt 24 and wingnut 28 excessively, which would completely hinder movement of the carrier plate 40.

As shown in FIGS. 1 and 2, the carrier plate 40 and scraper blade 30 are in the full forward position relative to the stripper blade 20, which serves as a point of reference. In FIG. 2, the device 10 is shown pull-scraping paint off a surface S. When the scraper blade 30 is in the full forward position, the stripper blade 20 appears retracted behind the plate 40 and is in non-operative contact with the surface S that is being scraped, thereby preventing the stripper blade 20 from interfering with the scraping of the surface. Furthermore, during the course of pull-scraping, the downward motion of the device 10 against the surface S generates an upward force against the blade 32A which, in addition to the bolt 24 and wingnut 28, maintains the carrier plate 40 and scraper blade 30 in the full forward position relative to the stripper blade 20.

Figure 4:
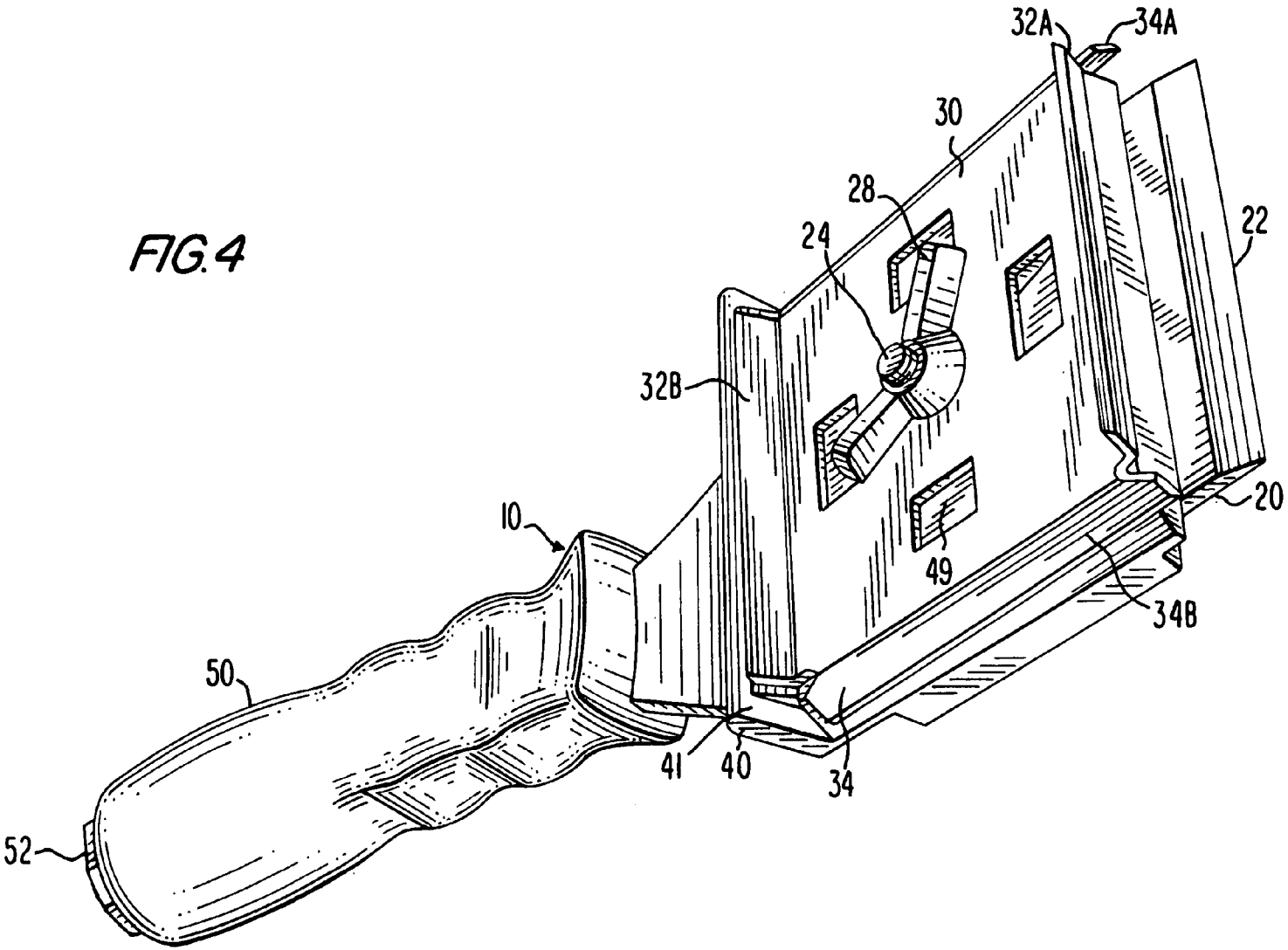
FIG. 4 is a bottom perspective view of the inventive push-pull stripper-scraper, with the scraping blade in the retracted or rearward position.

Conversely, as shown in FIGS. 4 and 5, the carrier plate 40 and scraper blade 30 are in the full rearward position relative to the stripper blade 20, which serves as a point of reference. In FIG. 5, the device 10 is shown push-stripping loose paint off a surface. When the plate 40 and blade 30 are in the full rearward position, the chisel edge 22 of the stripper blade 20 is operatively exposed allowing it to freely contact the surface S that is being stripped, as the chisel edge is urged by a worker in the direction D'. Likewise since they are in the retracted position, the plate 40 and blade 30 are prevented from interfering with the stripping of loose paint or coatings from a surface.

Importantly, the device 10 allows a user to easily switch between utilizing the scraping blade 30 and the stripping blade 20. In particular, after employing scraping blade 30 set in the extended position as shown in FIG. 2, a user may simply apply pressure to the working edge 32A of the blade 30 by pressing it against the surface S, forcing the plate 40 and blade 30 to slide in the direction of the handle 50 along axis X. As the plate 40 and blade 30 progress rearward, the chisel edge 22 of the stripper blade 20 becomes exposed to operatively engage the surface S. When the plate 40 and blade 30 are in the full rearward position, as shown in FIGS. 4 and 5, a user rotates the device 10 about axis X at approximately 180 degrees and then utilizes the stripping blade 20 to strip loose paint or debris from the surface that was scraped as shown in FIG. 5. Likewise, after utilizing the operatively exposed stripping blade 20, a user may rotate the device 10 about axis X at approximately 180 degrees, hold the working edge 32 of the scraping blade 30 against the surface and pull on the handle 50. This slidably moves the plate 40 and scraping blade 30 back into the full forward position shown in FIGS. 1 and 2. As discussed below, this feature is particularly advantageous when utilizing the device 10 in conjunction with an extension pole.

Figure 8:
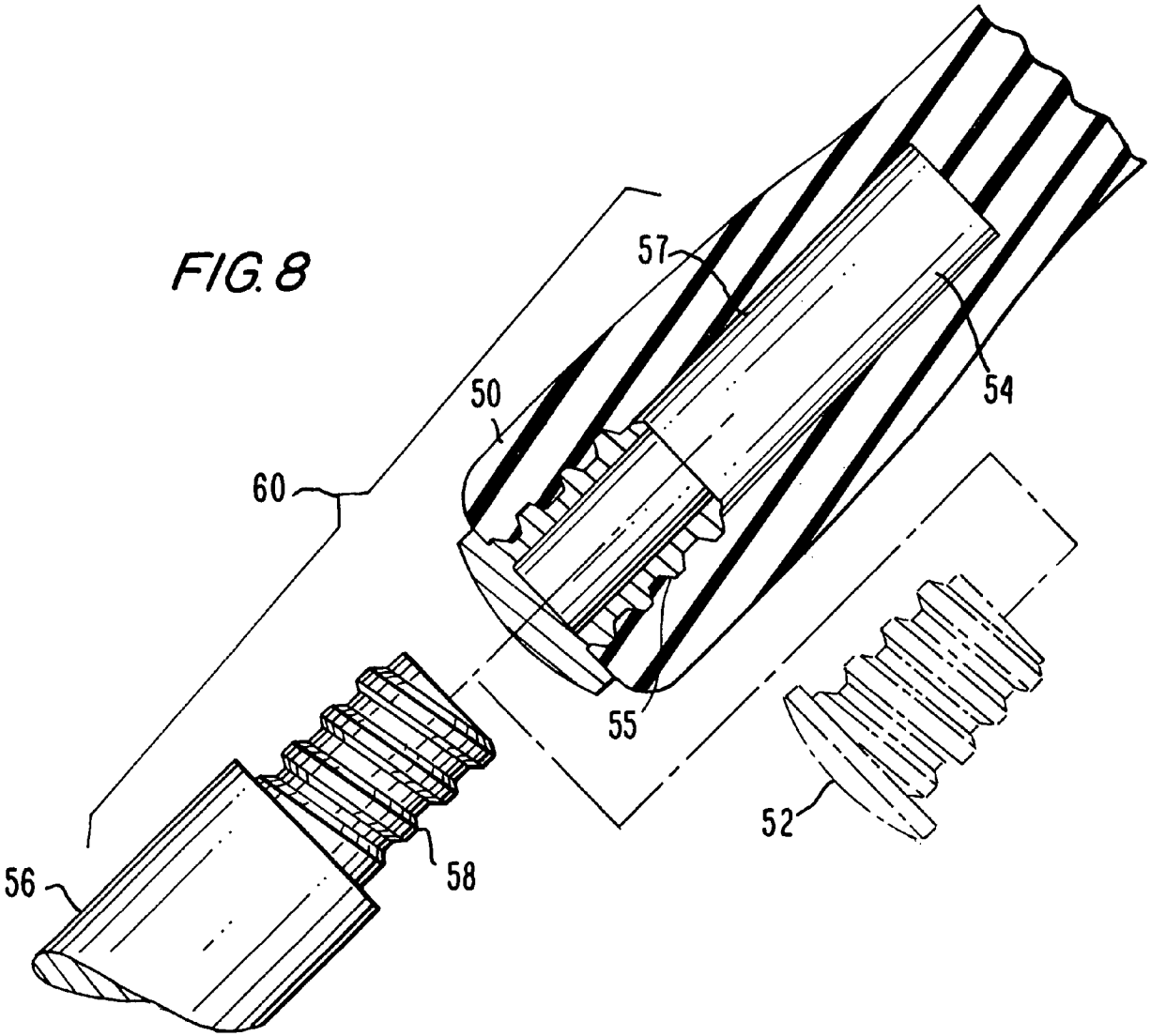
FIG. 8 is a partial cross sectional view of the push-pull stripper-scraper taken along line 8—8 of FIG. 1.

As shown in FIG. 8, the push-pull stripper-scraper 10 includes a soft ergonomic handle 50, made of elastomeric material, with a threaded cavity 54 having a lower threaded portion 55 and an aligned bore 57, adapted to selectively attach to a matching end of a pole 56 with a threaded extension 58 or other extension device. This feature allows a user to scrape and strip both elevated surfaces and floors without the use of a ladder or requiring a user to get on his hands and knees.

Even more significantly, when the device 10 is attached to an extension pole 56, a user can alter the position and function of the tool, from scraping to stripping and vice versa, while remaining six feet or more from the working edge of the device 10, depending on the length of the pole 56. For example, a user employing the stripping blade 20 can simply rotate the device, hold the quadruple edged scraping blade 30 against a surface S and pull on the pole 56. As force is applied, the blade 30 and carrier plate 40 slide forward along axis X and the tool shifts to "pull scraping" mode. Likewise the device can easily be shifted to stripping mode by applying pressure against the scraping blade forcing it rearward relative to the stripping blade. Accordingly, with the device 10, a user no longer has to manually unscrew and substitute a conventional stripping tool for a scrapping tool on the end of an extension pole. Instead the switch can be effectively made at a distance with one fluid motion.

Moreover, when the pole 56 is not used, a heavy die cast metallic threaded insert 52 which corresponds to the threaded cavity 54 may be utilized in place of the pole 56 at the rear or proximal end of the handle 50. This insert 52 has a broad head 60 and may be optionally used as a hammerhead to drive loosened nails below a surface before painting or other coatings are applied.

Although the invention is described in terms of a particular embodiment, it is to be understood that the embodiment described herein is merely illustrative of an application of the principles of the invention. Numerous modifications may be made and other arrangements may be devised without departing from the spirit and scope of the invention.

The invention claimed is:

1. A multifunction tool for stripping and scraping coatings from surfaces comprising:

a first blade having a stripping edge, adapted to strip coatings from surfaces;

a second blade having at least one scraping edge, adapted to scrape coatings from surfaces;

a carrier plate adapted to retain said second blade and adapted to slidably engage said first blade;

fastening means for fixedly engaging said carrier plate to said second blade and slidably engaging said carrier plate to said first blade along a predetermined distance which defines an extended position and a retracted position; and a handle wherein said handle is joined to an end of said first blade opposite said stripping edge wherein said carrier plate and said second blade can shift between said extended position and said retracted position relative to said first blade;

wherein said first blade is selectively capable of coming into operative contact with a surface when said carrier plate and said second blade are in a retracted position relative to said first blade; and further wherein said second blade is selectively capable of coming into operative contact with a surface when said carrier plate and said second blade are in an extended position relative to said first blade.

2. The tool of claim 1, wherein said handle comprises an elastomeric material.

3. The tool of claim 1, wherein said end of said first blade is internally joined to said handle.

4. The tool of claim 1, wherein said handle comprises a threaded cavity.

5. The tool of claim 4, wherein said threaded cavity is adapted to a corresponding end of an extension means.

6. The tool of claim 5 wherein said extension means comprises a pole.

7. The tool of claim 4, further comprising a metal insert for driving nails, wherein said cavity is adapted to corresponding end of said insert.

8. The tool of claim 1, wherein said stripping edge comprises a single chisel edge.

9. The tool of claim 1, wherein said at least one scraping edge comprises a plurality of scraping edges and wherein said plate is configured to allow for only one scraping edge of said second blade to come into an operative scraping contact position.

10. The tool of claim 9, wherein said at least one scraping edge comprises a plurality scraping edges in a symmetrical configuration.

11. The tool of claim 10, wherein said second blade may be oriented so that any one of said plurality of scraping edges may be selected and placed in said operative scraping contact position.

12. The tool of claim 11, wherein said second blade is formed such that the scraping edges are oriented by a combination of rotating said second blade in a direction generally parallel to said plate and flipping over said second blade such that only one of said scraping edges is in an operative contact position when said second blade is fastened to said plate.

13. The tool of claim 1, wherein said first blade comprises a first aperture, said second blade comprises a second aperture and said plate comprises a third aperture, wherein said second and said third apertures are in alignment with one another and said first aperture is correspondingly positioned to be aligned in part with said second and said third apertures.

14. The tool of claim 13, wherein said first aperture is elongated.

15. The tool of claim 14, wherein said handle comprises a space for inserting an extension pole.

16. The tool of claim 14, wherein said at least one scraping edge comprises multiple sharpened edges.

17. The tool of claim 14, wherein said at least one scraping edge comprises a plurality of sharpened curved edges adapted for fine scraping.

18. The tool of claim 14, wherein said at least one scraping edge comprises a plurality of sharpened flat edges adapted for rough scraping.

19. The tool of claim 18, wherein said carrier plate is constructed to prevent contact between all but one of said plurality of said sharpened edges and a surface.

20. The tool of claim 1, wherein said fastening means comprises a bolt and a tightening member.

21. The tool of claim 20, wherein said tightening member is a wingnut.

22. A multifunction tool for stripping and scraping coatings from surfaces comprising:

a first blade having a stripping edge, adapted to strip coatings from surfaces;

a second blade having a first pair of edges and a second pair of edges, wherein when said first pair is angled in a generally downward direction said second pair is angled in a generally upward direction;

a carrier plate adapted to retain said second blade and adapted to slidably engage said first blade; and fastening means for fixedly engaging said carrier plate to said second blade and slidably engaging said carrier plate to said first blade along a predetermined distance which defines an extended position and a retracted position;

wherein said carrier plate and said second blade can shift between said extended position and said retracted position relative to said first blade;

wherein said first blade is selectively capable of coming into operative contact with a surface when said carrier plate and said second blade are in a retracted position relative to said first blade; and further wherein said second blade is selectively capable of coming into operative contact with a surface when said carrier plate and said second blade are in an extended position relative to said first blade.

23. The tool of claim 22, wherein the edges said first pair and the edges of said second pair are located opposite one another respectively.

24. A multifunction tool for stripping and scraping coatings from surfaces comprising:

a first blade having a stripping edge, adapted to strip coatings from surfaces;

a second blade having at least one scraping edge, adapted to scrape coatings from surfaces;

a carrier plate adapted to retain said second blade and adapted to slidably engage said first blade;

fastening means for fixedly engaging said carrier plate to said second blade and slidably engaging said carrier plate to said first blade along a predetermined distance which defines an extended position and a retracted position; and two parallel channels located at opposite sides of said carrier plate for slidably engaging said carrier plate to said first blade wherein said carrier plate and said second blade can shift between said extended position and said retracted position relative to said first blade; and wherein said first blade is selectively capable of coming into operative contact with a surface when said carrier plate and said second blade are in a retracted position relative to said first blade; and further wherein said second blade is selectively capable of coming into operative contact with a surface when said carrier plate and said second blade are in an extended position relative to said first blade.

25. The tool of claim 24 wherein said second blade and said carrier plate are adapted to move in unison with one another along said first blade.

26. A tool for mechanically removing a coating from surfaces comprising:

a first blade having a stripping edge, adapted to act on coatings of surfaces;

a second blade having a scraping edge, adapted act on coatings of surfaces;

a carrier member adapted to retain one of said first blade and said second blade and adapted to be in sliding connection with the other of said first blade and said second blade;

a handle joined to an end of one of said first blade opposite said stripping edge and said second blade opposite said scraping edge; and fastening means for fixedly engaging said carrier member to one of said first and second blades and slidably engaging said carrier member to the other of said first and second blades along a predetermined distance which defines an extended position and a retracted position; and wherein said carrier member and one of said first or second blades shift between said extended position and said retracted position which permit operative contact of only one of said first and second blades.

27. The tool of claim 26, wherein said first blade, said second blade and said carrier member comprise apertures which are in proper alignment to permit sliding connection of said carrier member with one of said first and second blades, and fixed engagement between said carrier member and the other of said first and second blades.

28. The tool of claim 27, wherein said fastening means comprises a bolt inserted through said apertures.

29. The tool of claim 28, wherein said fastening means further comprises a tightening member to secure said bolt.

30. The tool of claim 29, wherein said tightening member is tightened to said bolt to permit slidable movement of said carrier member along one of said first and second blades.

31. The tool of claim 30, wherein said fastening means in conjunction with said aperture on one of said first and second blades, prevents said carrier member from disengaging said one of said first and second blades.

32. The tool of claim 29, wherein said fastening means is selectively tightened to prevent independent movement of said carrier member from occurring without the external application of force to said carrier member.

33. A combined stripping and scraping tool comprising:

a first blade having a stripping edge;

a second blade having a scraping edge;

a carrier adapted to slideably engage said first blade and said second blade to one another;

a fastener adapted to retain said first blade and said second blade in sliding engagement with one another; and a handle attached to one of said first blade opposite said stripping edge and said second blade opposite said scraping edge.

34. A tool comprising:

a first blade having a first operative edge;

a second blade having a second operative edge;

a carrier plate adapted to retain said second blade and adapted to slidably engage said first blade;

fastening means for fixedly engaging said carrier plate to said second blade and slidably engaging said carrier plate to said first blade along a predetermined distance which defines an extended position and a retracted position; and a handle, said handle being joined to an end of said first blade opposite said first operative edge.

35. The tool of claim 34, said first operative edge being a stripping edge and said second operative edge being a scraping edge.

36. The tool of claim 34, said first operative edge being a scraping edge and said second operative edge being a stripping edge.

37. The tool of claim 34, said handle comprising a hollow interior adapted to receive a pole.

38. The tool of claim 34, said handle having a soft thermoplastic cover.

* * * * *